US008484917B2

(12) United States Patent
McClain et al.

(10) Patent No.: US 8,484,917 B2
(45) Date of Patent: Jul. 16, 2013

(54) MUD-SILL ANCHOR

(75) Inventors: Thomas Barth McClain, Pleasanton, CA (US); Scott James Fischer, San Jose, CA (US); Jin-Jie Lin, Livermore, CA (US); Paul Howard Oellerich, Hayward, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 82 days.

(21) Appl. No.: 12/259,042

(22) Filed: Oct. 27, 2008

(65) Prior Publication Data

US 2009/0165409 A1 Jul. 2, 2009

Related U.S. Application Data

(63) Continuation of application No. 11/873,345, filed on Oct. 16, 2007, now abandoned.

(51) Int. Cl.

| | |
|---|---|
| ***E02D 27/00*** | (2006.01) |
| ***E02D 27/32*** | (2006.01) |
| ***E04B 1/38*** | (2006.01) |
| ***E04C 5/00*** | (2006.01) |

(52) U.S. Cl.
USPC ..... 52/293.3; 52/295; 52/712

(58) Field of Classification Search
USPC ..... 52/293.3, 295, 712, 714, 715, 713, 52/695, 300, 369, 370
See application file for complete search history.

(56) References Cited

U.S. PATENT DOCUMENTS

| | | | |
|---|---|---|---|
| 589,079 | A | 8/1897 | Glazier |
| 887,217 | A | 5/1908 | Oliphant |
| 908,310 | A | 12/1908 | McDonald |
| 953,060 | A | 3/1910 | Ross |
| 1,741,776 | A | 12/1929 | Isaacson |
| 1,767,575 | A | 6/1930 | Bujack |
| 1,848,422 | A | 3/1932 | Isaacson |
| 1,909,984 | A | 5/1933 | Prindle |
| 2,431,104 | A | 11/1947 | Bright |
| 2,438,604 | A | 3/1948 | Gogerty |
| 2,467,115 | A | 4/1949 | Duggan |
| 2,829,514 | A | 4/1958 | MacLean |
| 2,920,477 | A | 1/1960 | Shaw |
| 3,000,145 | A | 9/1961 | Fine |
| 3,122,223 | A | 2/1964 | Chell |
| 3,172,238 | A | 3/1965 | Sandin |
| 3,413,773 | A | 12/1968 | Fitzgerald |
| 3,422,585 | A | 1/1969 | Dismukes |

(Continued)

FOREIGN PATENT DOCUMENTS

| | | |
|---|---|---|
| AU | 103 929 | 5/1938 |

OTHER PUBLICATIONS

Golden Gate Equipment, Mudsill Anchor, Catalog page, Jan. 1974.

(Continued)

*Primary Examiner* — Andrew Triggs
(74) *Attorney, Agent, or Firm* — James R. Cypher; Charles R. Cypher

(57) ABSTRACT

A sheetmetal mud-sill anchor for anchoring a sill plate to a concrete foundation having an embedded leg and a pair of laterally spaced arms connected to the upper end of the leg extending away from the embedded leg. The arms are adapted for bending around a sill member and have fastener openings for connecting the anchor to the sill member.

11 Claims, 3 Drawing Sheets

U.S. PATENT DOCUMENTS

| | | | | | |
|---|---|---|---|---|---|
| 3,471,988 | A | | 10/1969 | Allen | |
| 3,729,882 | A | | 5/1973 | Allen | |
| 3,750,360 | A | * | 8/1973 | Kingston | 52/714 |
| 3,782,058 | A | | 1/1974 | Allen | |
| 3,889,440 | A | | 6/1975 | Sutter | |
| 3,889,441 | A | * | 6/1975 | Fortine | 52/715 |
| 3,893,274 | A | | 7/1975 | Salisbury | |
| 3,998,026 | A | * | 12/1976 | Allen | 52/714 |
| 4,005,942 | A | | 2/1977 | Gilb | |
| 4,096,677 | A | | 6/1978 | Gilb | |
| 4,202,149 | A | | 5/1980 | Betrue, Sr. | |
| 4,329,826 | A | | 5/1982 | Flogaus et al. | |
| 4,404,781 | A | * | 9/1983 | Gilb | 52/295 |
| 4,413,456 | A | * | 11/1983 | Gilb | 52/295 |
| 4,422,279 | A | | 12/1983 | Powell | |
| 4,570,403 | A | | 2/1986 | Dannemiller | |
| 4,706,428 | A | | 11/1987 | McCoy et al. | |
| 4,739,598 | A | * | 4/1988 | Jensen et al. | 52/295 |
| 4,924,648 | A | | 5/1990 | Gilb et al. | |
| 4,932,818 | A | | 6/1990 | Garwood | |
| 5,060,436 | A | | 10/1991 | Delgado, Jr. | |
| 5,072,570 | A | | 12/1991 | Johnson | |
| 5,143,472 | A | | 9/1992 | Reed et al. | |
| 5,150,553 | A | | 9/1992 | Commins et al. | |
| 5,174,083 | A | * | 12/1992 | Mussell | 52/169.1 |
| 5,317,850 | A | | 6/1994 | Colonias et al. | |
| 5,335,469 | A | | 8/1994 | Stuart | |
| 5,357,721 | A | | 10/1994 | Alvarez | |
| 5,379,563 | A | | 1/1995 | Tinsley | |
| 5,390,455 | A | | 2/1995 | Antolini | |
| 5,442,887 | A | | 8/1995 | Welsh | |
| 5,467,569 | A | | 11/1995 | Chiodo | |
| 5,595,031 | A | | 1/1997 | Commins | |
| 5,813,182 | A | | 9/1998 | Commins | |
| 6,254,306 | B1 | | 7/2001 | Williams | |
| 6,560,943 | B1 | | 5/2003 | Leek et al. | |
| 6,658,806 | B1 | | 12/2003 | Leek | |
| 6,796,099 | B1 | | 9/2004 | Georges et al. | |
| 7,254,919 | B2 | | 8/2007 | Lutz et al. | |
| 7,549,262 | B2 | | 6/2009 | Roessett et al. | |
| 7,762,031 | B2 | | 7/2010 | Leek et al. | |
| 7,793,476 | B2 | | 9/2010 | Sanders et al. | |
| 2004/0040236 | A1 | | 3/2004 | Adams | |

OTHER PUBLICATIONS

Silver Metal Products, FA Foundation Anchor, Catalog page, Apr. 1972.

Simpson Strong-Tie Company, Strong-Tie Connectors, Jan. 1981, Catalog No. 81H-1, p. 3, San Leandro, CA.

Simpson Strong-Tie Company, Strong-Tie Connectors, Jan. 1979, Catalog No. 79H-1, p. 5, San Leandro, CA.

Simpson Strong-Tie Company, Connectors for Wood Construction Product & Instruction Manual, Jan. 1995, C95H-1, pp. 18 and 19, Pleasanton, CA.

Simpson Strong-Tie Company, Wood Construction Connectors, Jan. 1998, C98, p. 9, Pleasanton, CA.

Simpson Strong-Tie Company, Wood Construction Connectors, Dec. 2007, C-2008, pp. 22,23,24, Pleasanton, CA.

KC Metals SuperSpeed Connectors, Connectors and Seismic Ties for Concrete, Steel Studs, Engineered Wood Products and Wood Construction, 2003, pp. 90, 91 and front and back covers, C03R1, KC Metal Products, Inc. San Jose, California.

USP Catalog, 1998, unknown page number and back cover, USP706-981, United Steel Products Company, Burnsville, Minnesota.

Hughes Manufacturing, Inc. Product Catalog, 1997, p. 41 and front cover, Hughes Manufacturing, Inc, Largo, Florida.

* cited by examiner

MUD-SILL ANCHOR

BACKGROUND OF THE INVENTION

There are several different accepted ways to attach a wood sill plate to the top of a foundation wall or slab. One way is to set threaded anchor bolts into the concrete foundation and pour the uncured concrete around the bolts. Holes are then drilled in the sill plate and the plate is then set on the foundation with the anchor bolts protruding through the openings in the sill plate.

Several sheet metal connectors have been designed to replace or provide alternatives to using threaded anchor bolts to connect the sill plate or mud sill to the foundation. Examples of such sheet metal anchors are found in U.S. Pat. Nos. 3,889,441, 3,750,360, 4,413,456 and 4,739,598. U.S. Pat. Nos. 3,889,441 and 3,750,360 are designed with a pair of arms which protrude on either side of the sill plate. The arm on the inner side of the plate, like an anchor bolt placed in the foundation can interfere with the process of screeding and trowling the slab. The present invention is similar to U.S. Pat. Nos. 4,413,456 and 4,739,598, and improves upon them.

The present invention has been designed so that multiple anchors can be spaced along the edge of a foundation with the same spacing that would be used with two of the more common anchor bolt sizes for anchoring a mud sill, specifically anchors bolts having a diameter of either ½" or ⅝". That is to say, the mud-sill anchor of the present invention is strong enough to replace a typical, commercially used anchor bolt of either ⅝" or ½" diameter set in the same concrete foundation.

SUMMARY OF THE INVENTION

The anchor of the present invention provides a cost effective and convenient way to anchor a mudsill to a poured concrete foundation.

The anchor of the present invention provides reinforcing to the top-attachment arms to strengthen the anchor.

The parallel top-attachment arms provide spacing which meets the requirements of the international conference of building officials (uniform building code) for six (6) or eight (8) nail attachment to the mud sill.

The heavily bossed and footed embeddment element provides full withdrawal resistance in any direction.

The mud sill anchor can be placed either prior to or immediately after the pouring of the concrete.

The present invention provides an anchor which can be attached to the form by driving a flat-head nail through the anchor and into the form, and because of the shape of the anchor and the placement of the nail through the connector into the form, the form board can be stripped from the foundation when the concrete has cured without requiring the removal of the nail attaching the connector to the form.

The anchor permits full finishing operations of the concrete without interference from upright elements or double-nail heads.

A pair of tab members provides placement stability when the anchor is attached to the foundation form.

After installation, the anchor has no upstanding elements and therefore a frame wall does not have to be lifted over any upstanding anchor members.

The anchor is shaped and embedded in the concrete in such a manner that there is minimal exposure of the metal of the connector to the elements after the form boards are stripped from the concrete foundation, so as to prevent rusting of the hanger.

DETAILED DESCRIPTION OF THE INVENTION

Figure 1:
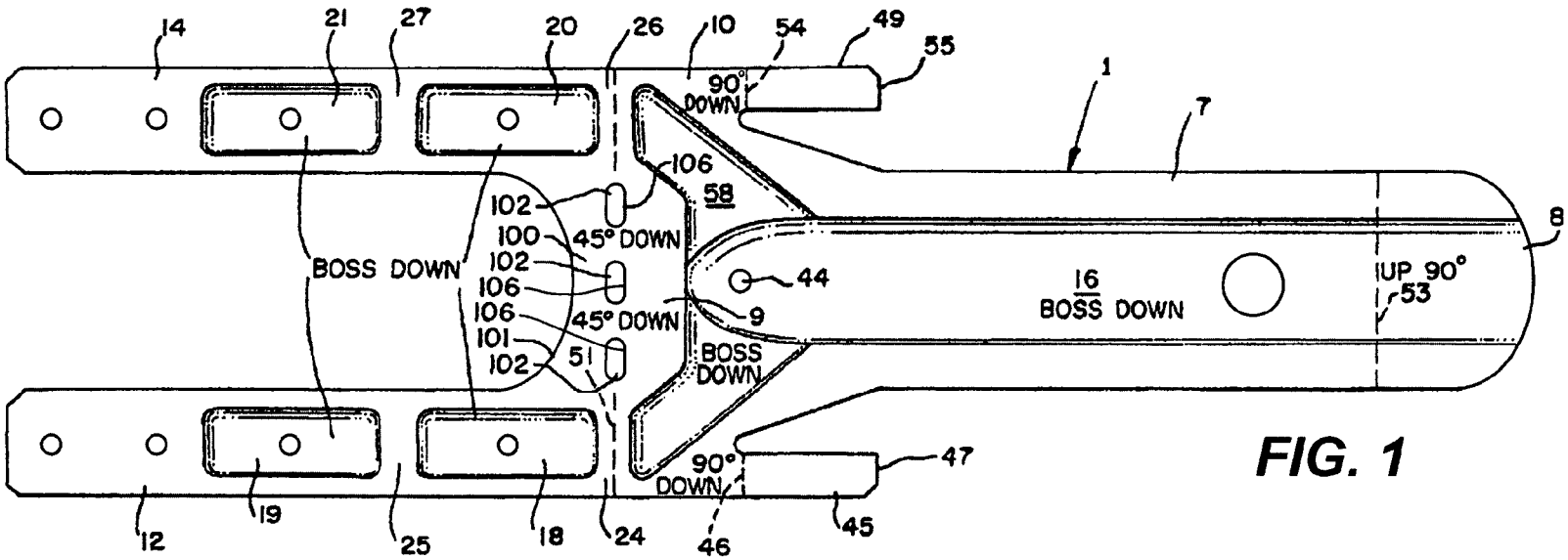
FIG. 1 is a top plan view of the sheet metal blank from which the mud sill anchor of the present invention is constructed.
Figure 2:
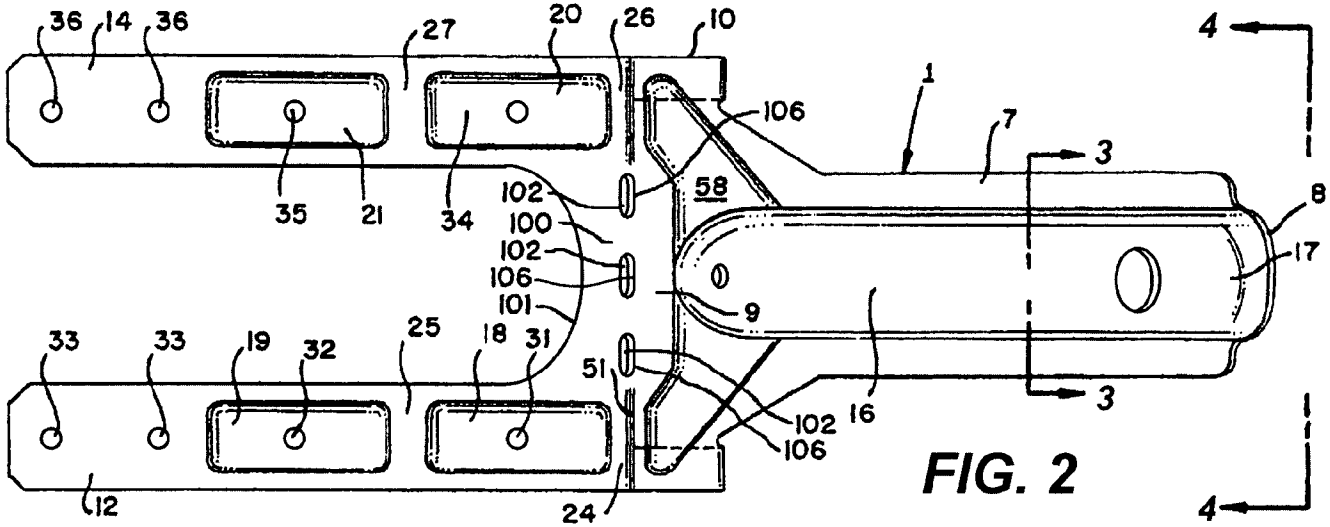
FIG. 2 is a top plan view of the anchor of the present invention as constructed from the blank of FIG. 1.
Figure 3:
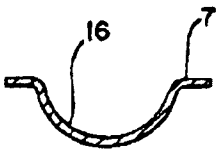
FIG. 3 is a cross sectional view of a portion of the anchor taken along line 3-3 of FIG. 2.

The sheet metal mudsill anchor 1 of the present invention is used for anchoring a sill plate 2 to a concrete foundation 3. The foundation has a top surface 13 and a perimeter face 104 that meets the top surface at a perimeter edge 105. The anchor is temporarily attached to a form member 4 by means such as a nail 6. The anchor is preferably formed from a single piece of sheet metal as illustrated in FIG. 1. The anchor consists briefly of an embedded leg 7 having a distal end 8.

The embedded leg 7 is positioned downwardly at an angle within the foundation 3 and away from the form member or form board 4. The embedded leg 7 has an upper end portion 9 that is formed with a T-shaped member 10 for receiving a first mud-sill attachment arm 12 integrally connected to the upper end of the T-shaped member 10 and extends above and outwardly from the form board 4, during pouring of the concrete, wherein the plane of the arm is generally parallel to the top surface 13 of the foundation. The first mud-sill attachment arm 12 connects to the T-shaped member 10 at bend line 51 which is positioned at the upper terminal edge 106 of leg 7.

A second mud-sill attachment arm 14 integrally connected to the other side of the T-shaped member 10 extends above and outwardly from the form board 4 in generally the same plane as the first mud-sill attachment arm 12 and generally parallel thereto, during the pouring of the concrete. The second mud-sill attachment arm 14 connects to the T-shaped member 10 at bend line 51.

A central, bridge member 100 disposed on the same side of bend line 51 and upper terminal edge 106 of leg 7 as the first and second mud-sill attachment arms 12 and 14 provides a direct connection between the first mud-sill attachment arm 12 and the second mud-sill attachment arm 14 on the side of bend line 51 to which the first and second mud-sill attachment arms 12 and 14 are disposed. Central, bridge member 100 has a preferably scalloped outer edge 101. Central, bridge member is preferably substantially planar with first and second mud-sill attachment arms 12 and 14. In the preferred embodiment, three (3), linearly arranged obround openings 102 are formed in the connector along the bend line 51 to provide controlled weakening of the connector so it can be bent in the field as needed.

Anchor leg 7 is formed with an embossment 16 which extends substantially the length of the leg 7.

Preferably, the distal end 8 of the leg 7 is formed with an angularly upturned portion 17 which increases the mechanical engagement with the foundation 3.

Arms 12 and 14 are formed with longitudinally aligned embossed portions 18, 19, 20 and 21 and are made pre-bent along bend line 51 to a 45 degree angle for the most preferred positioning of the anchor 1 in the foundation 3.

The arms 12 and 14 each have a length selected for extending up the side edge 22 and over a substantial portion of the upper side 23 of the sill 2. The embossed portions 18-21 are interrupted at each of two selected bend points 24-27 which occur at the edges 28 and 29 of the sill 2.

Arms 12 and 14 are formed with fastener openings 31-36 for driving fasteners 37-42 therethrough and into the sill 2.

A restricted opening 44 is formed in the upper end of leg 7 for receiving fastener 6 positioned for engaging the form member 4 and permitting the removal of the form member 4 without withdrawing the fastener 6 from the form 4.

Positioning tabs 45 and 49 may be formed from leg 7 and bent along bend lines 46 and 54 so that it extends rearwardly and engages the face 11 of the foundation form member 4. When the ends 47 and 55 of tabs 45 and 49 engage the face of the foundation, they cooperate with the arms 12 and 14 resting on top edge 56 of the form in positioning the anchor at a preselected angle 48 with respect to the form member 4.

As an example, referring to FIG. 1, the anchor 1 may be formed from a 16 gauge galvanized steel blank 3"×10.25". The leg member 7 to be embedded in concrete is approximately 6.0" long, with a boss 16 having a 0.625"×0.3125" draw depth, terminating in a 0.875" bossed hook element 17 bent to 90 degrees along bend line 53. Two 0.9375" by 0.3125" tapered positioning tabs 45 and 49 are provided at 90 degrees from the leg 7 for standoff positioning purposes when the unit is installed at the required 45 degree angle. Installed, the vertical embedded depth is approximately four (4) inches. The two (2) legs 12 and 14 are 4.25" long, each having two bosses and four holes sized for N10 nails.

Installation assumes concrete having minimum compressive strength characteristics to meet typical code requirements, with spacing and other location control in accordance with typically used building codes in the United States. The legs 12 and 14 are so configured as to provide code-spaced nailing for eight (8) 10d or N10 (1.5" long) nails when attached to mudsills of nominal 2" by 4", 3" by 4", 2" by 6", 3" by 6" or like dimensions.

Installation is permitted wherever not less than four (4) inches of concrete depth is provided. If such depth is over a horizontal cold joint such as to a concrete foundation wall, or foundation wall formed of concrete block, then separate means must be provided as required for connecting the elements adjacent to the horizontal cold joint.

Figure 5:
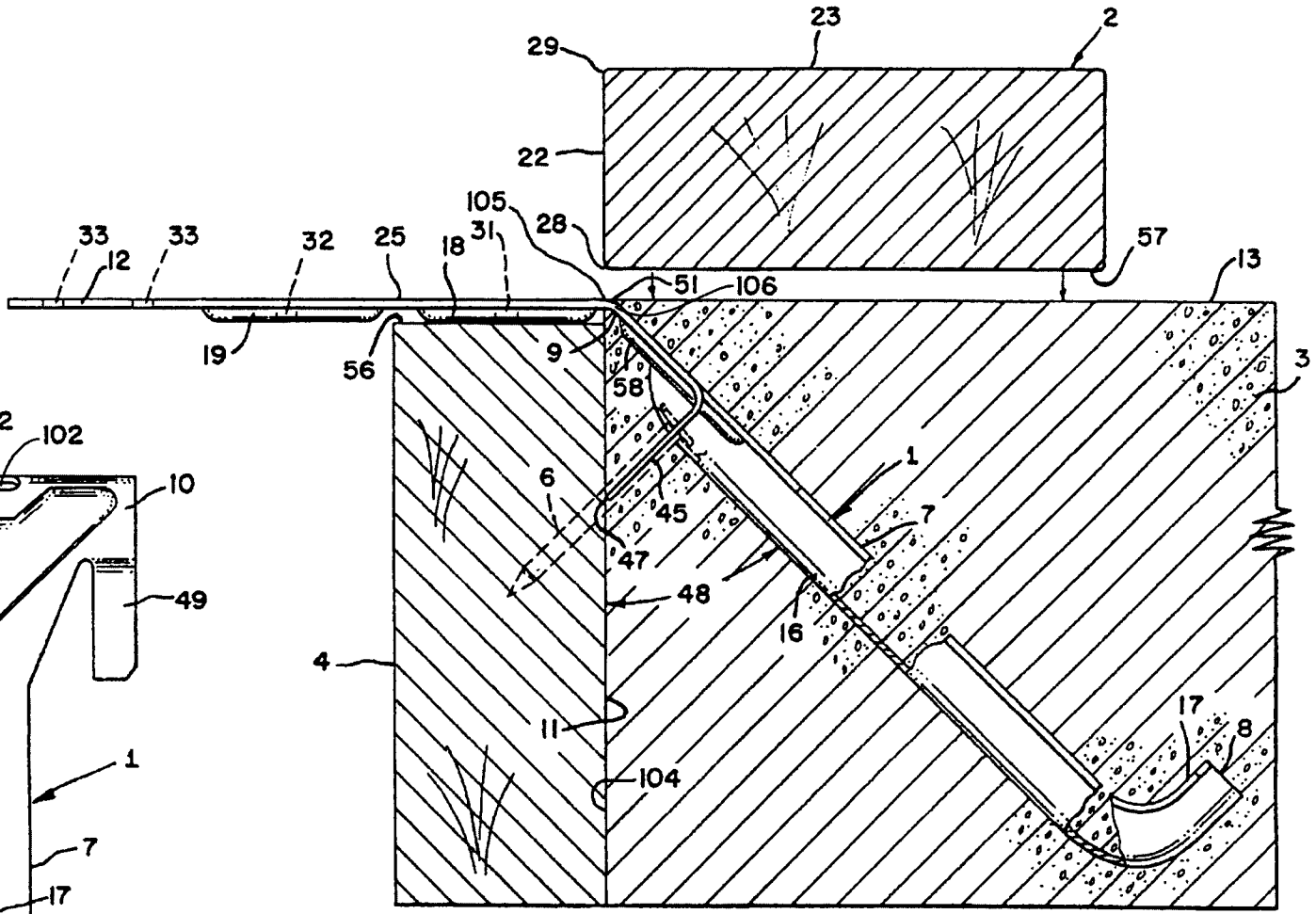
FIG. 5 is a side elevation view of the anchor with portions in cross section. The anchor is shown embedded in a concrete foundation and attached to a form board. The sill member is illustrated to show its location after the form board has been removed.
Figure 4:
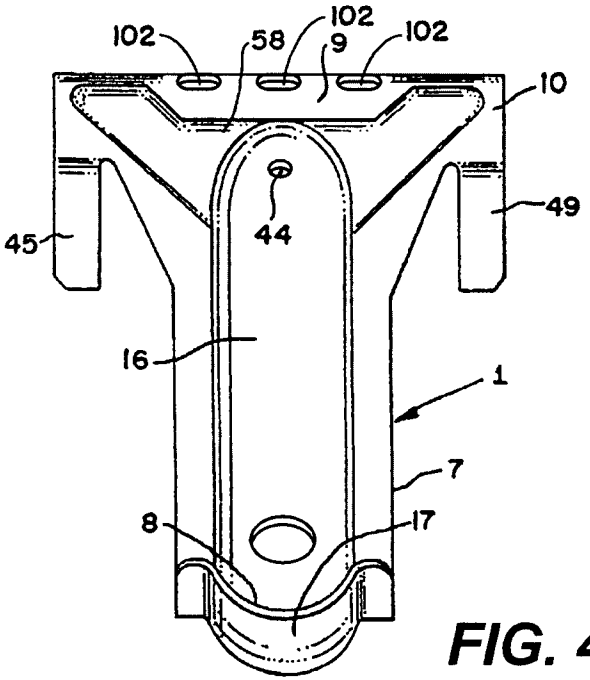
FIG. 4 is a front elevation view of the anchor shown in FIG. 2 taken in the direction of arrows 4-4 of FIG. 2.
Figure 7:
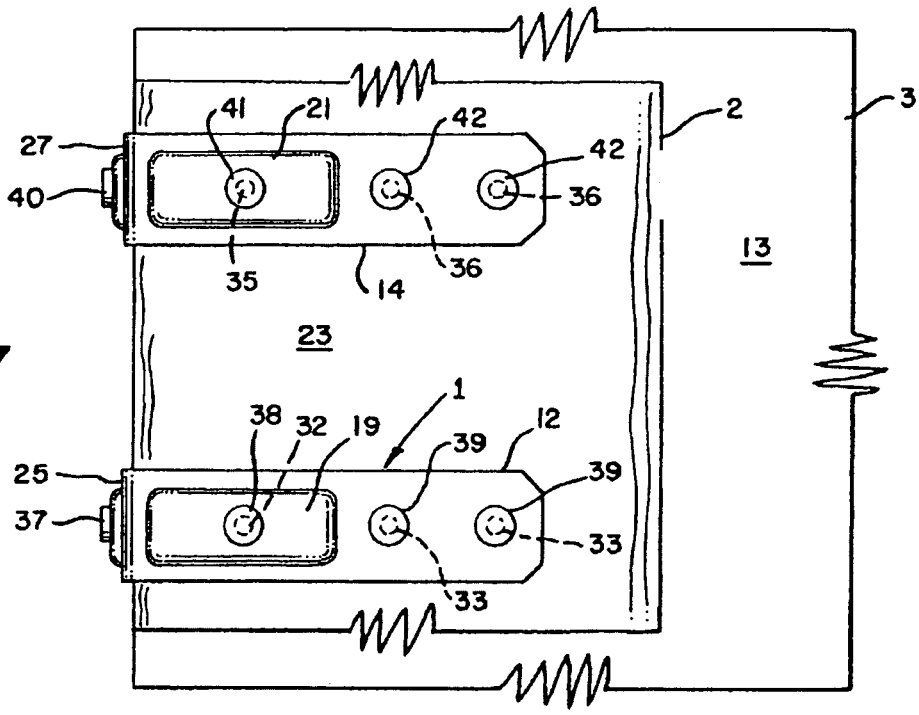
FIG. 7 is a top view of the anchor member attached to a sill member as shown in FIG. 6.
Figure 6:
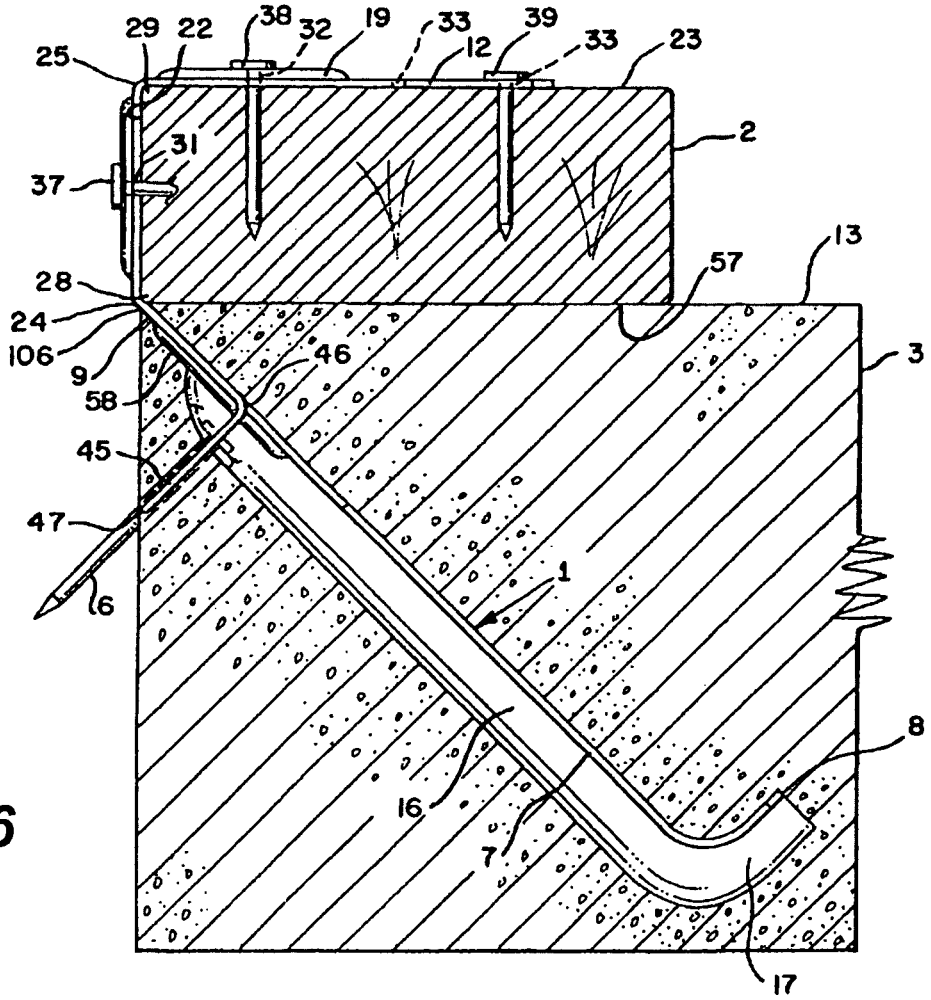
FIG. 6 is a side view of the anchor connected to the sill member. The concrete foundation is shown in cross section.

Referring to FIGS. 5, 6 and 7, the anchor 1 is preferably installed prior to pouring the concrete slab. The anchor is placed as shown in FIG. 5. Nail 6 is driven through opening 44 into form board 4.

After the concrete is poured and sets, the form board 4 may be stripped from the foundation 3 without removing nail 6. Preferably no other nails are driven through the arms 12 and 14 into the form boards 4.

Because of the shape of the leg 7, the position, shape and angle of tabs 45 and 49 to leg 7, and the placement of the attachment nail 6, when the form board 4 is removed only the ends 47 and 55 of tabs 45 and 49, nail 6 and the upper terminal edge 106 of the upper end 9 of the leg 6 are exposed below the top surface 13 of the concrete foundation 3, minimizing the exposure of the anchor 1 to the elements which could cause corrosion of the anchor 1 and the weakening of the connection.

To complete the connection, the bottom side 57 of mudsill 2 is placed on top of the concrete 13 and arms 12 and 14 are bent upwardly 90 degrees in areas 24 and 26, along side edge 22 of the sill member. The arms 12 and 14 are then bent again in areas 25 and 27 so that the arms are in contact with the upper face 23 of the sill member. Nails 37-42 are then driven into the sill member 2.

The mudsill anchor 1 is designed so that there is a minimum waste in cutting and so that cutting and forming may be accomplished by progressive die techniques. For example, the leg 7 has an unformed width of 1.25" and this is the dimension between legs 12 and 14. Preferably the T-shaped member 10 is embossed in portions 58 to strengthen the upper end 9 of the leg member 7.

We claim:

1. A mud-sill anchor for anchoring a sill plate to a concrete foundation comprising:

a. a concrete foundation having a generally horizontal top surface and an outer perimeter face that meets said top surface at a perimeter edge;

b. a sill plate having a top face and a side edge, said side edge of said sill plate being positioned in alignment with said perimeter face of the said concrete foundation; wherein c. said mud-sill anchor is formed from a single piece of sheet metal and includes an embedded leg having a distal end embedded at an angle to said top surface of said foundation, said embedded leg being positioned downwardly within said foundation and inwardly from said perimeter of said foundation and having an upper end with an upper terminal edge positioned adjacent the perimeter edge of said foundation;

d. said anchor includes first and second laterally spaced mud-sill attachment arms integrally connected to said upper end of said leg at a bend line positioned at said upper terminal edge of said leg, said first and second laterally spaced mud-sill attachment arms extending outwardly from said leg and away from said upper terminal edge of said upper end of said leg and said foundation perimeter surface;

e. said first and second laterally spaced mud-sill attachment arms are connected by a central, bridge member, the bridge member disposed on the same side of said bend line as the first and second mud-sill attachment arms and oppositely from said leg at said upper terminal edge of said upper end of said leg, said central, bridge member being integrally connected to said upper end of said leg at said bend line positioned at said upper terminal edge of said leg, said central, bridge member extending outwardly from said leg and away from said upper terminal edge of said upper end of said leg and said foundation perimeter surface;

f. said first and second laterally spaced mud-sill attachment arms are positioned and have a length that spans and interfaces with said sill plate edge and a substantial portion of said sill plate top face;

g. fastener means connecting said first and second arms to said top face of said sill plate; and wherein h. said leg and said upper end of said leg are positioned adjacent the perimeter edge of said foundation such that only the upper terminal edge of the leg reaches the perimeter face of the foundation and only at the perimeter edge of the foundation and the remainder of the leg of the anchor is embedded in the foundation, wherein:

said upper terminal edge of said upper end of said leg is at said bend line between said leg and said first and second mud-sill attachment arms, and openings are formed in the anchor on the bend line between the leg and the first and second mud-sill attachment arms and the central, bridge member, and the central, bridge member and the first and second mud-sill attachment arms are not embedded in the foundation.

2. An anchor as described in claim 1 comprising:

a. first and second positioning tabs formed from said upper end of said leg and extending at an angle thereto and having terminal edges that extend substantially to the perimeter face of the foundation.

3. An anchor as described in claim 1, wherein:

said openings formed in the anchor at the upper terminal edge and on the bend line between the leg and the first and second mud-sill attachment arms and the central, bridge member are elongated and linearly arranged on the bend line to provide controlled weakening of the anchor.

4. An anchor as described in claim 3, wherein:

said openings formed in the anchor on the bend line between the leg and the first and second mud-sill attachment arms and the central, bridge member are obround.

5. An anchor as described in claim 4, wherein:

said openings formed in the anchor on the bend line between the leg and the first and second mud-sill attachment arms and the central, bridge member are centrally disposed away from the outer edges of the anchor.

6. An anchor as described in claim 5, wherein:

said central, bridge member has a scalloped outer edge.

7. An anchor as described in claim 1, wherein:

said openings formed in the anchor on the bend line between the leg and the first and second mud-sill attachment arms and the central, bridge member are centrally disposed away from the outer edges of the anchor.

8. An anchor as described in claim 7, wherein:

said openings formed in the anchor at the upper terminal edge and on the bend line between the leg and the first and second mud-sill attachment arms and the central, bridge member are elongated and linearly arranged on the bend line to provide controlled weakening of the anchor.

9. An anchor as described in claim 8, wherein:

said openings formed in the anchor on the bend line between the leg and the first and second mud-sill attachment arms and the central, bridge member are obround.

10. An anchor as described in claim 9, wherein:

said central, bridge member has a scalloped outer edge.

11. An anchor as described in claim 1, wherein:

said central, bridge member has a scalloped outer edge.

* * * * *